US005699480A

United States Patent [19]

Martin

[11] Patent Number: 5,699,480

[45] Date of Patent: Dec. 16, 1997

[54] APPARATUS FOR IMPROVING DISTURBED SPEECH SIGNALS

[75] Inventor: Rainer Martin, Aachen, Germany

[73] Assignee: Siemens Aktiengesellschaft, Munich, Germany

[21] Appl. No.: 673,151

[22] Filed: Jul. 1, 1996

[30] Foreign Application Priority Data

Jul. 7, 1995 [DE] Germany ..... 195 24 847.3

[51] Int. Cl.[6] ..... G10L 3/02

[52] U.S. Cl. ..... 395/2.14; 395/2.35

[58] Field of Search ..... 395/2.14, 2.12, 395/2.35, 2.36, 2.38, 2.42, 2.43; 367/901; 375/285; 455/222; 364/574

[56] References Cited

U.S. PATENT DOCUMENTS

| | | | |
|---|---|---|---|
| 4,912,767 | 3/1990 | Chang | 395/2.14 |
| 5,012,519 | 4/1991 | Aldersberg et al. | 395/2.35 |
| 5,150,414 | 9/1992 | Ng | 395/2.35 |
| 5,319,736 | 6/1994 | Hunt | 395/2.12 X |
| 5,406,622 | 4/1995 | Silverberg et al. | 379/387 |
| 5,432,859 | 7/1995 | Yang et al. | 395/2.35 X |
| 5,490,231 | 2/1996 | Kane et al. | 395/2.35 |
| 5,572,621 | 11/1996 | Martin | 395/2.36 |
| 5,590,241 | 12/1996 | Park et al. | 395/2.12 X |
| 5,621,850 | 4/1997 | Kane et al. | 395/2.42 X |
| 5,644,641 | 7/1997 | Ikeda | 395/2.35 X |

FOREIGN PATENT DOCUMENTS

| | | |
|---|---|---|
| PS 32 30 391 | 2/1984 | Germany . |
| PS 38 08 038 | 9/1989 | Germany . |

OTHER PUBLICATIONS

"Suppression Of Acoustic Noise In Speech Using Spectral Subtraction," Boll, IEEE Trans On Acoustics, Speech and Sig. Proc., vol. ASSP-27, No. 2, Apr. 1979, pp. 61–68.

"Noise Reduction Based On Microphone Array With LMS Adaptive Post-Filtering," Zelinski, Electronics Letters, vol. 26, No. 24, Nov. 22, 1990, pp. 2036–2037.

"A Microphone Array With Adaptive Post-Filtering For Noise Reduction In Reverberant Rooms," Zelinski, Proc. Int. Conf. Acoustics, Speech and Sig. Proc. '88 (1988), pp. 2578–2581.

"Statistical-Model-Based Speech Enhancement Systems," Ephraim, Proc. of the IEEE, 80, No. 10, Oct. 1992, pp. 1526–1555.

"Adaptive Noise Cancelling: Principles And Applications," Widrow et al., Proc. Of The IEEE, vol. 63, No. 12, Dec. 1975, pp. 1692–1716.

*Primary Examiner*—Allen R. MacDonald
*Assistant Examiner*—Scott Richardson
*Attorney, Agent, or Firm*—Hill, Steadman & Simpson

[57] ABSTRACT

An apparatus for the transmission of speech signals reduces the effect of disturbances on the transmission quality. Two microphones are provided for picking up speech signals. Signal processing ensues in three partial frequency bands. The microphone signals are high-pass filtered in a lower frequency band, in the middle frequency band the signal is weighted with a scalar factor, so that this frequency band is damped during the speech pauses, and in the upper frequency band, an adaptive filter is used. At the beginning of the processing, a treble enhancement of the signals ensues, which is canceled by an inverse filter before the output of the improved signal.

2 Claims, 2 Drawing Sheets

APPARATUS FOR IMPROVING DISTURBED SPEECH SIGNALS

BACKGROUND OF THE INVENTION

1. Field of the Invention

The present invention is directed to an apparatus for improving disturbed speech signals, and in particular to an apparatus for permitting transmissions of speech signals from a patient disposed in a medical examination apparatus wherein the apparatus may produce the disturbances in the speech signals.

2. Description of the Prior Art

Speech signals can be used in medical technology for the transmission of information about a patient. In particular in computed tomography or in nuclear magnetic resonance, in which the patient lies in an examination apparatus, the communication between the patient and the operating personnel ensues via a single microphone in the examination apparatus. It is thereby necessary to transmit the speech signals to the exterior of the examination apparatus in as disturbance-free a manner as possible. Since only one microphone is used, dynamic disturbances in the speech signal cannot be compensated (reduced).

SUMMARY OF THE INVENTION

An object of the present invention is to provide an apparatus wherein disturbed speech signals are so far improved that the disturbances have no negative influence on the transmission of information.

The above object is achieved in an apparatus for improving speech signals having at least two acoustic input signals wherein processing of the speech signals is undertaken in three separate frequency bands. The speech signals, such as microphone signals, are highpass-filtered in a lower frequency band, each signal is weighted with a scalar factor in a middle frequency band so that this frequency band is damped during speech pauses, the scalar weighting in the middle frequency band being set on the basis of an estimated signal-to-noise ratio. An adaptive filter is used in the upper frequency band, the coefficients of which being calculated by weighting of the averaged filter coefficients with a window function (for example a hamming function). At the beginning of the signal processing, a treble enhancement of the signals is undertaken, and this is canceled after the above processing by an inverse filter, the output of this input filter constituting the improved speech signal.

The lower frequency band can lie between 0 and 240 Hz, the middle frequency band can be between 240 and 800 Hz, and the upper frequency band can be between 800 and 3400 Hz.

DESCRIPTION OF THE PREFERRED EMBODIMENTS

Figure 1:
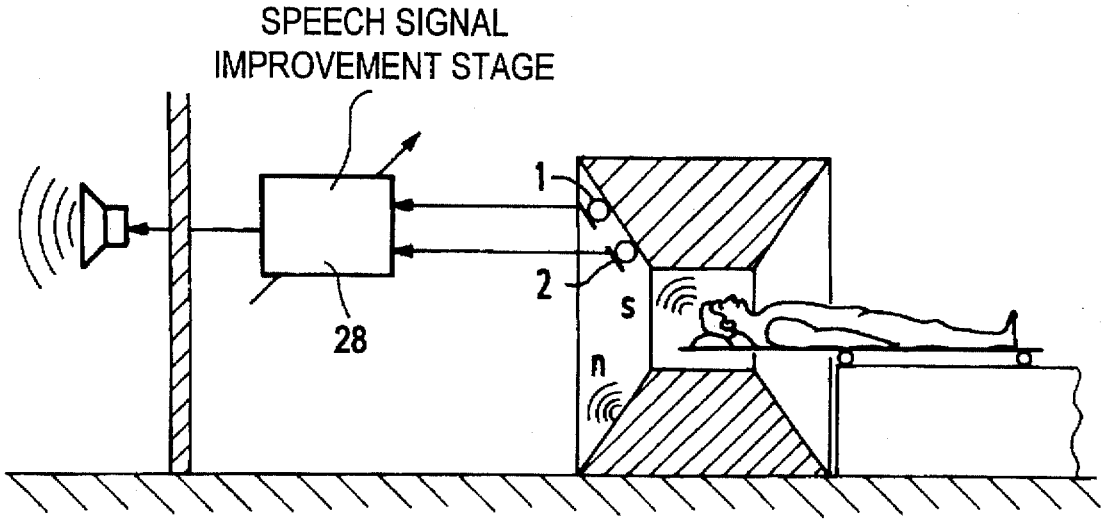
FIG. 1 is a schematic representation of a medical examination apparatus with a transmission system for speech signals constructed in accordance with the principles invention.

FIG. 1 shows a medical apparatus, e.g. a computed tomography apparatus, having a measurement field in which a patient lies. For communication of the patient with the exterior of the apparatus, two microphones 1 and 2 are attached to the apparatus, whose signals are transmitted out via a speech signal improvement stage 28.

Figure 2:
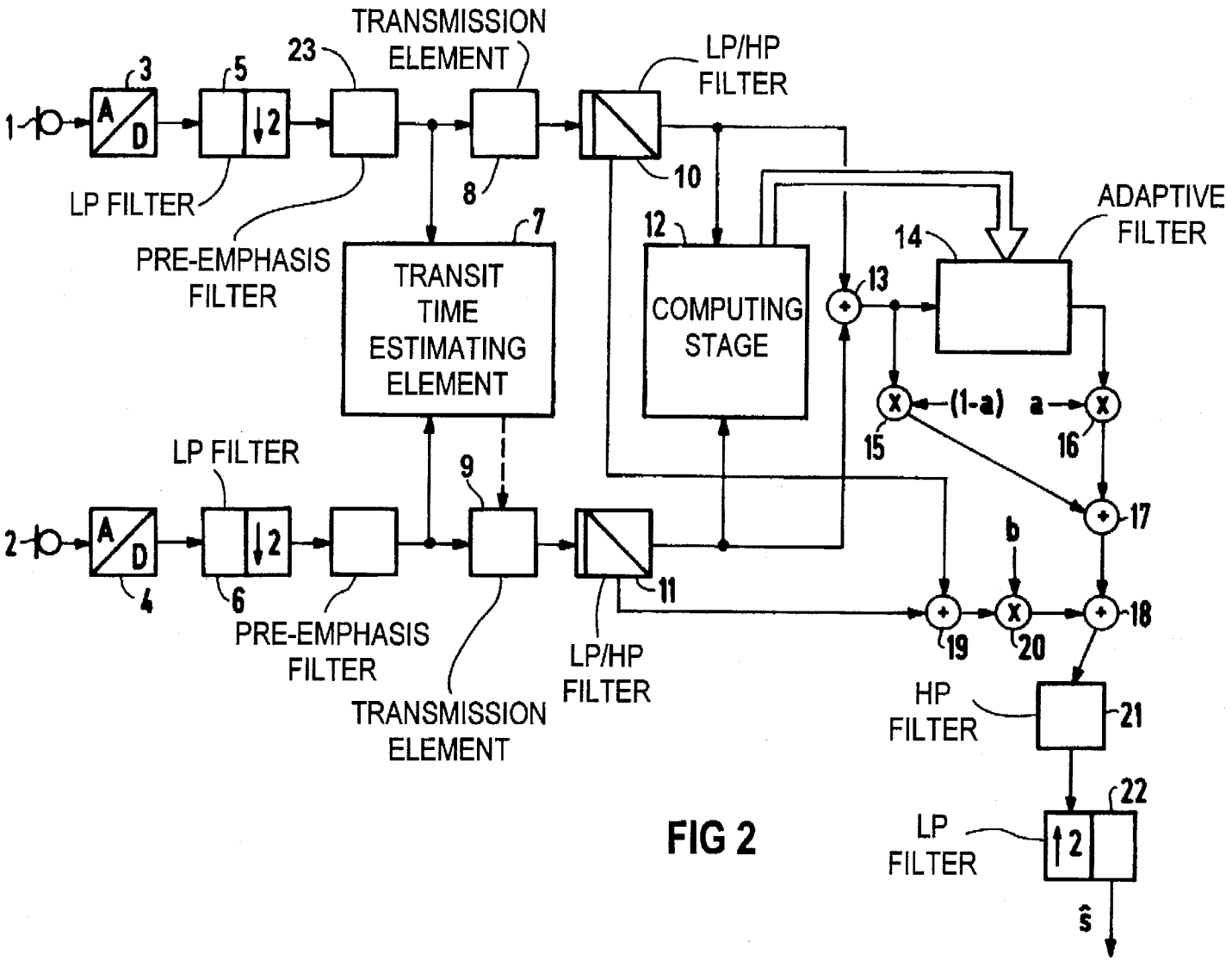
FIG. 2 is a block diagram of the transmission system according to FIG. 1.

FIG. 2 shows the basic components of the speech signal improvement stage 28. The microphones 1 and 2 are respectively connected to channels respectively containing A/D converters 3 and 4, low-pass filters 5 and 6 for halving the sampling rate, pre-emphasis filters 23, transmission elements 8 and 9, and low-pass/high-pass filters 10 and 11 for frequency band partitioning.

The outputs of the filters 10 and 11 are supplied to a computing stage 12 for adaptive calculation of the coefficients of an adaptive filter 14 connected to which the sum of the outputs of the filters 10 and 11 is supplied via an adder 13.

A transit time estimating element 7 controls the transmission elements 8 and 9 to bring the two microphone signals into phase with respect to the voice signal parts. Since the voice signal parts of the two microphone signals are highly correlated and the noise parts are relatively uncorrelated, the aforementioned control of transmission elements 8 and 9 can ensue in the transit time estimating element by calculating the cross-correlation of the two signals. The maximum of the cross-correlation function indicates the time offset prevailing between the voice signal parts. A suitable method is described, for example, in G. C. Carter: "Coherence and Time Delay Estimation", Proc. IEEE, Vol. 75, No. 2, pp. 236–255, February 1987. A constant signal delay corresponding to the maximally possible time offset is then set in the transmission element 8, whereas the transmission element 9 sets the variable signal delay calculated by the transit time estimating element 7.

The output to sum from the adder 13 and the output of the adaptive filter 14 are added (mixed) in an adder 17, after being respectively weighted in multipliers 15 and 16. The weighting takes place by means of respective multiplicands (1–a) and (a), with the factor "a" being selected to have a value between 0 and 1. The outputs of the filters 10 and 11 are added in an adder 19, and are damped by multiplying the sum output of the adder 19 by a factor b ($0.05 \geqq b \geqq 0.8$) in a multiplier 20. The outputs of the multiplier 20 and the adder 17 are added in an adder 18, the output of which is supplied to a high-pass filter 21. The output of the high-pass filter 21 is supplied to a low-pass filter 22, which doubles the sampling rate.

The algorithm is designed for a sampling rate of 8 kHz. Higher sampling rates are not possible given the predetermined computing capacity and are also not absolutely required, since a low-pass limiting of the signal to 3.6 kHz due to the broadband disturbances is perceived as a subjective improvement of the signal.

The algorithm has the following features.

In digital recursive low-pass filters 5 and 6, order and sampling rate conversion from 16 kHz to 8 kHz takes place. The sampling rate conversion is required, since the A/D converters 3 and 4 in the existing hardware cannot be switched over to a sampling rate of 8 kHz.

Automatic propagation time compensation is accompanied by means of correlation and maximum search and SNR (signal/noise ratio) detection in the transit time estimating element 7. The propagation time compensation of the microphone signals is accurate to about half of a sampling interval.

Frequency band partitioning is made at 800 Hz for the reduction of low-frequency noise. Only the upper frequency band is subjected to the adaptive filtering.

Disturbing noise suppression is accomplished with two adaptive filters 26 and 27 (FIG. 3) in the computing stage 12, the summing signal filter 14 and pre-emphasis filters 23. The adaptive filters 26 and 27 in the computing element 12 are reset in a linear-phased manner, e.g. with the NLMS algorithm. The number of coefficients of these filters can be varied within small limits in dependence on the processor load. For the linear-phase processing, a maximum of 59 coefficients are provided. The coefficients of the summation signal filter 14 are spectrally smoothed.

The adaptive filters 26 and 27 in the computing stage 12 are readjusted linear-phased, for example, with the NLMS algorithm, so that the mean square error between the filter output signal and the reference signal is minimized. Since the voice signal parts of the microphone signals are highly correlated and the noise signal parts are largely uncorrelated, the filter coefficients are set with this procedure such that the two adaptive filters 26 and 27 allow the voice parts to pass unattenuated, whereas the noise parts are attenuated. Delay elements 24 and 25 (FIG. 3) are required for the linear-phased adaptation of the filters 24 and 25. When the filters 24 and 25 are equipped with N coefficients, the delay elements 24 and 25 delay the signals by (N-1)/2 sampling clocks. The embodiment with two filter arranged mirror-symmetrically effects an improved estimating of the unwanted noise reduction filter. The filtering of the sum signal in the filter 14 therefore ensures with the average of the two filter coefficient sets calculated in the computing stage 12. The pre-emphasis filters 23 are realized as FIR filters with fixed coefficients and effect an amplification of the high-frequency signal pads. The high-frequency voice signal parts are thereby particularly lent greater weight in the further processing.

The variable mixture of the disturbed input signal and the filtered output signal with the aforementioned factor "a" is for the improvement of the subjective impression, and therefore the factor "a" is selected by the listener.

Digital recursive high-pass filter 21 suppresses low-frequency disturbing noises. The boundary frequency is at 240 Hz; the blocking attenuation is about 20 dB. The ripple in the passband is less than 0.5 dB. It is presupposed that the analog high-pass filters of the A/D converters 3 and 4 are active.

The digital non-recursive low-pass filter 22 is of the order 12–20 and the sampling rate conversion is from 8 kHz to 16 kHz.

The filtering of the microphone signals by means of the digital high-pass filter 21 takes place at the output of the disturbance suppression system. Due to the band partitioning and the pre-emphasis filtering, the adaptation of the disturbing noise suppression filter 21 is no longer disturbed by low-frequency disturbance portions, so that this filtering can also ensue after the adaptive filtering.

The signal in the low-pass signal branch is adaptively weighted in dependence on the SNR determined in the course of the propagation time compensation. An additional damping of the disturbing noise in the speech pauses is thereby achieved.

For the further optimization of the remaining disturbing noise, the high-frequency portions are damped during the speech pauses by a low-pass filter. The damping is carried out according to the same criteria as the damping of the low-frequency signal branch.

The adaptive filter 14 at the output of the system may be omitted. The filtered signals of the adaptive filter in the computing stage 12 are then emitted directly to the subsequent summation element 18. This variant has the lowest expense and still produces a good speech quality.

The signals filtered in the computing stage 12 may be additionally filtered with the filter 14 (doubled adaptive filtering). This variant has the highest suppression of disturbing noise, but also the worst speech intelligibility.

The processing is carried out in three partial frequency bands. The microphone signals are high-pass-filtered in the frequency band 0–240 Hz. The signal is weighted with a scalar factor in the frequency band 240–800 Hz, so that this frequency band is damped during the speech pauses. The scalar weighting in the frequency band 240–800 Hz is set on the basis of an estimated SNR. The adaptive filter 14 is used in the upper frequency band 800 to 3400 Hz, which is calculated by averaging two linear-phase-adapted filters, with a corresponding algorithm being used for the adaptation and the coefficients are spectrally smoothed. The spectral smoothing is achieved through the weighting of the filter coefficients of the filter 14 with a suitable window function. At the beginning of the processing, a treble enhancement of the signals ensues by means of pre-emphasis filters 23, which is canceled by an inverse filter before the output of the improved signal.

Figure 3:
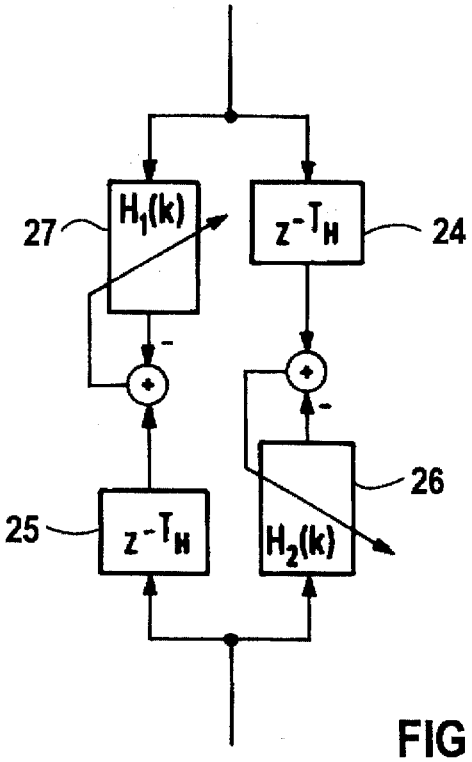
FIG. 3 is a block diagram of the computing element shown in FIG. 2.

FIG. 3 shows an exemplary embodiment of the computing element 12. The delays $T_H$ are chosen so that the adaptive filters approximate a non-causal Wiener filter.

Although modifications and changes may be suggested by those skilled in the art, it is the intention of the inventors to embody within the patent warranted hereon all changes and modifications as reasonably and properly come within the scope of their contribution to the art.

I claim as my invention:

1. An apparatus for improving disturbed speech signals comprising:

first and second microphone means for respectively receiving two acoustic input signals;

means for separating said acoustic input signals into a lower frequency band, a middle frequency band, and an upper frequency band;

means for a high-pass-filtering said acoustic input signals in said lower frequency band;

means for damping said acoustic input signals in said middle frequency band during speech pauses by weighting said acoustic input signals in said middle frequency band with a scalar factor;

means for setting said scalar factor dependent on an estimated signal-to-noise ratio of said acoustic input signals;

an adaptive filter for filtering said acoustic input signals in said upper frequency band, said adaptive filter having filter coefficients calculated by weighting averaged filter coefficients with a window function for spectrally smoothing said coefficients; and means for trebly enhancing said acoustic input signals at least before weighting said acoustic input signals in the middle frequency band and adaptively filtering the acoustic input signals in the upper frequency band, and an inverse filter which cancels said treble enhancement after weighting said acoustic input signals in said middle frequency and after adaptively filtering said acoustic input signals in said upper frequency band, said inverse filter having an output comprising an improved speech signal.

2. An apparatus as claimed in claim 1, wherein said means for partitioning said acoustic input signals comprises means for partitioning said acoustic input signals into a lower frequency band between 0 and 240 Hz, a middle frequency band between 240 and 800 Hz, and an upper frequency band between 0 and 3400 Hz.

* * * * *